US008827636B2

(12) United States Patent
Mariotti et al.

(10) Patent No.: US 8,827,636 B2
(45) Date of Patent: Sep. 9, 2014

(54) CONDUIT FOR TURBOMACHINE AND METHOD

(75) Inventors: Massimiliano Mariotti, Florence (IT); Luciano Mei, Florence (IT); Silvio Giachetti, Florence (IT)

(73) Assignee: Nuovo Pignone S.p.A, Florence (IT)

( * ) Notice: Subject to any disclaimer, the term of this patent is extended or adjusted under 35 U.S.C. 154(b) by 447 days.

(21) Appl. No.: 13/328,651

(22) Filed: Dec. 16, 2011

(65) Prior Publication Data

US 2012/0171021 A1 Jul. 5, 2012

(30) Foreign Application Priority Data

Dec. 30, 2010 (IT) ..... MI2010A2467

(51) Int. Cl.

| | |
|---|---|
| ***F04D 25/06*** | (2006.01) |
| ***F04D 29/058*** | (2006.01) |
| ***F04D 29/08*** | (2006.01) |
| ***F01D 25/16*** | (2006.01) |

(52) U.S. Cl.

CPC ..... *F01D 25/16* (2013.01); *F04D 29/083* (2013.01); *F04D 29/058* (2013.01); *F04D 25/0693* (2013.01); *F05D 2240/515* (2013.01)

USPC ..... 415/170.1; 415/104; 415/107; 415/229; 416/174

(58) Field of Classification Search

USPC ..... 415/104, 107, 170.1, 229; 416/174

See application file for complete search history.

(56) References Cited

U.S. PATENT DOCUMENTS

| | | | | |
|---|---|---|---|---|
| 2,605,315 | A | 7/1952 | Hargett | |
| 4,296,986 | A | 10/1981 | Herrmann, Jr. | |
| 4,986,764 | A | 1/1991 | Eaby et al. | |
| 5,580,266 | A | 12/1996 | Shelly | |
| 5,626,486 | A | 5/1997 | Shelly et al. | |
| 6,043,580 | A | 3/2000 | Vogel et al. | |
| 6,067,395 | A | 5/2000 | Cairns et al. | |
| 6,107,566 | A | 8/2000 | Quadir et al. | |
| 6,193,473 | B1 * | 2/2001 | Mruk et al. | 417/350 |
| 6,364,677 | B1 | 4/2002 | Nysveen et al. | |

(Continued)

FOREIGN PATENT DOCUMENTS

| | | | |
|---|---|---|---|
| DE | 69926042 | T2 | 5/2006 |
| DE | 102007044348 | A1 | 3/2009 |

(Continued)

OTHER PUBLICATIONS

Third Party Observations dated Jul. 29, 2013 from corresponding EP Application No. 11194675.2.

(Continued)

*Primary Examiner* — Igor Kershteyn

(74) *Attorney, Agent, or Firm* — GE Global Patent Operation

(57) ABSTRACT

A turbomachine includes a compressor having a cartridge that is configured to slide in and out of an external casing. The turbomachine further includes an electrical motor having a motor shaft configured to be connected to the compressor shaft. A conduit is configured to extend through the statoric part of the compressor or the motor, from a first magnetic bearing to the second magnetic bearing. The conduit includes conduit electrical cables provided inside the conduit and extending from a first end of the conduit to a second end of the conduit; and electrical cables connecting one of the first and second magnetic bearings to an external connector via the conduit electrical cables of the conduit.

20 Claims, 9 Drawing Sheets

(56) References Cited

U.S. PATENT DOCUMENTS

| | | | | |
|---|---|---|---|---|
| 6,616,421 | B2 * | 9/2003 | Mruk et al. | 417/350 |
| 7,772,506 | B2 | 8/2010 | Suter et al. | |
| 7,856,834 | B2 * | 12/2010 | Haley | 62/115 |
| 8,367,935 | B2 | 2/2013 | Bernauer et al. | |
| 2004/0058575 | A1 | 3/2004 | Nicholson | |
| 2005/0186823 | A1 | 8/2005 | Ring et al. | |
| 2007/0292097 | A1 | 12/2007 | Sumitani | |
| 2008/0017415 | A1 | 1/2008 | Suter et al. | |
| 2008/0314616 | A1 | 12/2008 | Benestad et al. | |
| 2010/0239419 | A1 | 9/2010 | Maier et al. | |
| 2010/0239437 | A1 | 9/2010 | Maier | |
| 2011/0021049 | A1 | 1/2011 | Ramasubramanian et al. | |
| 2011/0034066 | A1 | 2/2011 | Jazowski et al. | |
| 2011/0044832 | A1 | 2/2011 | Nijhuis | |
| 2011/0061896 | A1 | 3/2011 | Bernauer et al. | |

FOREIGN PATENT DOCUMENTS

| | | | |
|---|---|---|---|
| DE | 102008031994 | A1 | 11/2009 |
| DE | 102009011277 | A1 | 9/2010 |
| EP | 0355796 | A2 | 2/1990 |
| EP | 1675241 | A1 | 6/2006 |
| EP | 1830070 | A2 | 9/2007 |
| EP | 2040510 | A1 | 3/2009 |
| GB | 2217871 | A | 11/1989 |
| WO | 2009002187 | A1 | 12/2008 |
| WO | 2010070439 | A1 | 6/2010 |

OTHER PUBLICATIONS

IT Search Report in connection with IT Patent Application MI2010A002467 filed Dec. 30, 2010, issued on Jul. 21, 2011.

* cited by examiner

CONDUIT FOR TURBOMACHINE AND METHOD

BACKGROUND

1. Technical Field

Embodiments of the subject matter disclosed herein generally relate to methods and systems and, more particularly, to mechanisms and techniques for electrically connecting various internal parts of a turbomachinery to an external connection.

2. Discussion of the Background

During the past years, the importance of turbomachines in various industries has increased. A turbomachine is a compressor, expander, turbine, pump, etc. or a combination of them. The turbomachines are used in engines, turbines, power generation, cryogenic applications, oil and gas, petrochemical applications, etc. Thus, there is a need for improving the efficiency of the turbomachines.

One turbomachine often used in the industry includes a compressor driven by an electrical motor. Such a turbomachine may be employed, e.g., for recovering methane, natural gas, and/or liquefied natural gas (LNG). The recovery of such gasses would reduce emissions and reduce flare operations during the loading of LNG onto ships. Other uses of this kind of turbomachine are known in the art and not discussed here. However, it is noted that a shut down of such a machine is expensive as the entire process in which the machine is involved needs to be stopped. The shut down time of the machine depends, among other things, on how quick the internal parts of the compressor can be disassembly for obtaining access to the failed part. A compressor having magnetic bearings and being housed together with an electrical motor require free access to a space between the two machines for disconnecting an electrical cable from the magnetic bearings. This is undesirable as discussed next.

An example of such a turbomachine is shown in FIG. 1. The turbomachine 10 includes an electrical motor 12 connected to a compressor 14. The connection between the two machine shafts is achieved by a mechanical joint 16. The motor external casing 17 may be attached to the compressor external casing 19 by, for example, bolts 18. The compressor 14 may include one or more impellers 20 attached to a compressor shaft 22. The compressor shaft 22 is configured to rotate around a longitudinal axis X. The rotation of the compressor shaft 22 is enhanced by using magnetic bearings 24*a* and 24*b* at both ends of the compressor shaft.

However, the magnetic bearings 24*a* and 24*b* need a supply of electrical power in order to function. The electrical power is supplied to the magnetic bearings via cables 26 and 27. Cable 26 connects to the magnetic bearing 24*a* while cable 27 connects to the magnetic bearing 24*b*. Cable 26 is provided with a head 28 that is configured to mate with a corresponding head 30 of an external electrical cable 32. Cable 27 connects in a similar way to an external cable 33. Cables 26 and 27 are exposed to the media that is processed by the compressor. This media may be corrosive and likely to have a high pressure. Thus, specific precautions need to be taken for protecting the cables. Cables 26 and 27 may be attached to an internal wall of the compressor casing 19. The same is true for the motor 12, in which cables 40 and 42 connect magnetic bearings 44 of the motor to an outside power source.

A problem with such an arrangement is the following. When assembling or disassembling the turbomachine 10, personnel needs to connect or disconnect cable 26 from the magnetic bearing 24*a* in order to be able to remove the compressor 14. This step is performed by opening a hatch 40 so that a person could enter, partially or totally, into the turbomachine 10 and disconnect the cable 26 from the magnetic bearing 24*a*. The same operations need to be performed when removing the motor. These operations slow down the entire assembly or disassembly process, which is costly. Also, this method requires extra space in the design of the compressor so that the external hatch 40 is accommodated. Another problem is that to provide the necessary space to make the hatch 40 in the housing, it is required to have enough space, therefore the housing itself and the rotor need to be long enough. However, this increase in the casing and rotors generate rotor-dynamic and balancing issues, therefore increasing design and budding costs and the dimensions of the whole machine. Still another problem is that it is required to provide seals to dose the hatch 40, particularly important when the working gas is an acid. Yet another problem is that it is possible to test the electrical connections between the cables 26, 27 to the bearings 24*a*, 24*b* only when the compressor 14 is installed inside the housing 19.

Accordingly, it would be desirable to provide systems and methods that reduce a time for assembling or disassembling the turbomachine.

SUMMARY

According to an exemplary embodiment, there a turbomachine that includes a compressor having a cartridge that is configured to slide in and out of an external casing; first and second magnetic bearings provided at opposite ends of a compressor shaft and configured to support the compressor shaft; a motor having a motor shaft configured to be connected to the compressor shaft; a conduit configured to extend through a statoric part, from the first magnetic bearings to the second magnetic bearings, the conduit being configured to seal a first pressure region of the compressor from a second pressure region of the compressor; conduit electrical cables provided inside the conduit and extending from a first end of the conduit to a second end of the conduit; and electrical cables connecting one of the first and second magnetic bearings to an external connector via the conduit electrical cables of the conduit.

According to another exemplary embodiment, there is a compressor cartridge that includes a compressor connected to a driver machine; a compressor shaft configured to rotate relative to a statoric part of the compressor; first and second magnetic bearings provided at opposite ends of the compressor shaft; a conduit configured to extend through the statoric part such that projections on the compressor shaft of a first end of the conduit, impellers of the compressor and a second end of the conduit lie in this order, the conduit being configured to seal a first pressure region of the compressor from a second pressure region of the compressor; and the conduit includes conduit electrical cables configured to electrically connect the first magnetic bearing and an external connection and the second magnetic bearing is electrically connected to the external connection.

According to still another exemplary embodiment, there is a method for electrically connecting magnet bearings in a turbomachine to an external connector. The method includes connecting a first magnetic bearing to a first end of a conduit that extends through a statoric part of a compressor cartridge; connecting a first cable to a second end of the conduit; connecting a cable to a second magnetic bearing; sliding the compressor cartridge inside an external casing of the turbomachine until a compressor shaft of the compressor cartridge connects to a motor shaft of an electrical motor provided in the external casing; and connecting the first and second cables to an external connector.

According to yet another exemplary embodiment, there is a turbomachine that includes a compressor having a cartridge that is configured to slide in and out of an external casing; first and second magnetic bearings provided at opposite ends of a compressor shaft and configured to support the compressor shaft; a motor having a motor shaft configured to be connected to the compressor shaft; third and fourth magnetic bearings provided at opposite ends of the motor shaft; a first conduit configured to extend through the statoric part of the compressor, from the first magnetic bearings to the second magnetic bearings, the conduit being configured to seal a first pressure region of the compressor from a second pressure region of the compressor; a second conduit configured to extend through a statoric part of the motor, from a first magnetic bearings to a second magnetic bearings, the conduit being configured to seal a first pressure region of the motor from a second pressure region of the motor; and electrical cables connecting the magnetic bearings of the compressor and the motor to external connectors via conduit electrical cables of the first conduit and the second conduit.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a turbomachine having a centrifugal compressor connected to an electrical motor. However, the embodiments to be discussed next are not limited to this turbomachine, but may be applied to other turbomachines that include a gas turbine, an expander or other types of compressors.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, there is a conduit provided in a statoric part of a compressor for connecting to electrical cables that serve magnetic bearings or other devices. The conduit is configured to seal a first pressure region of the compressor from a second pressure region of the compressor. The conduit has electrical connectors at both ends that couple to corresponding receptacles for allowing electrical power to be provided to the magnetic bearings or other devices. A similar conduit may be built into the motor.

Figure 1:
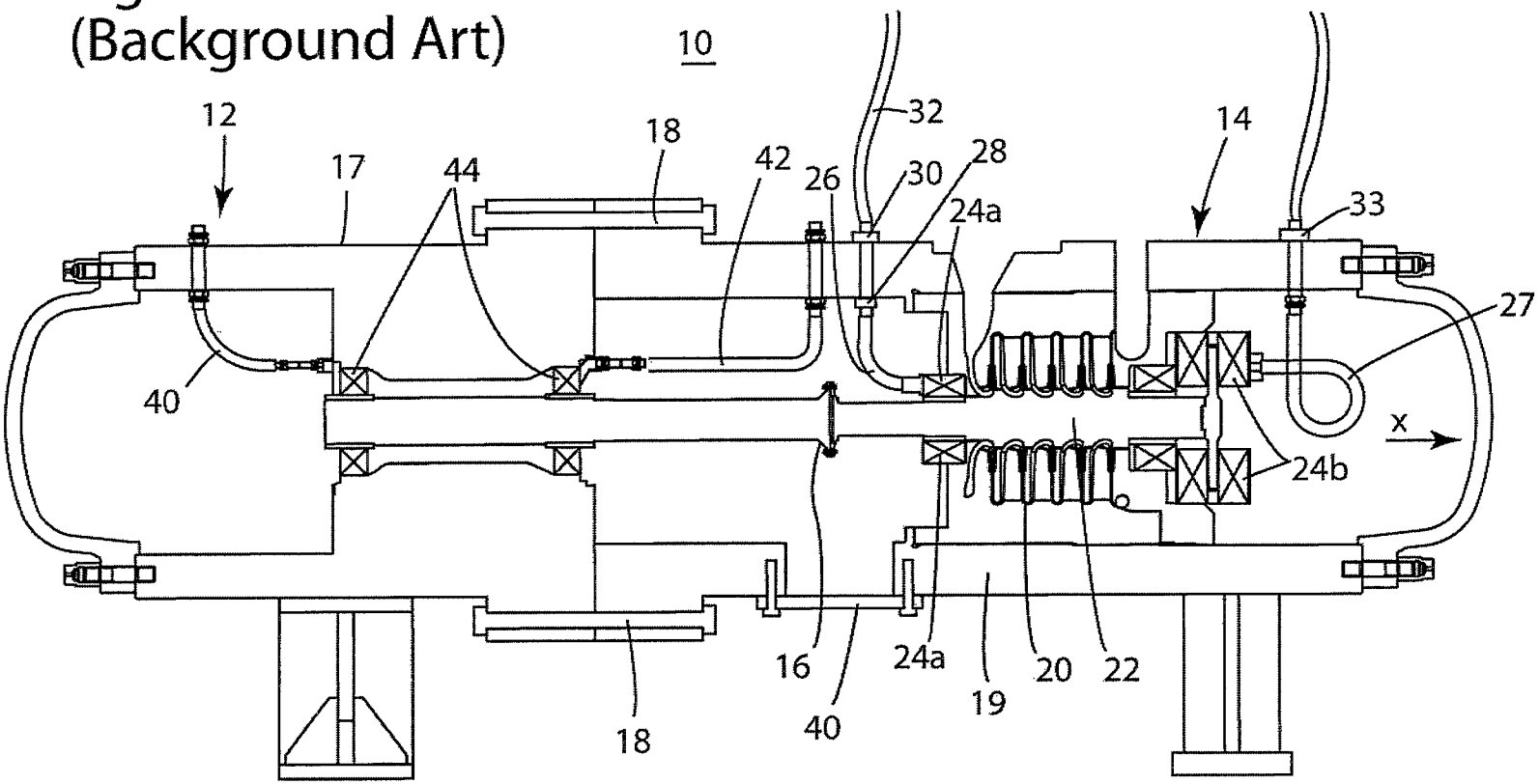
Figure 1 (Background Art)
FIG. 1 is a schematic diagram of a conventional turbomachine that includes an electrical motor and a compressor.
Figure 2:
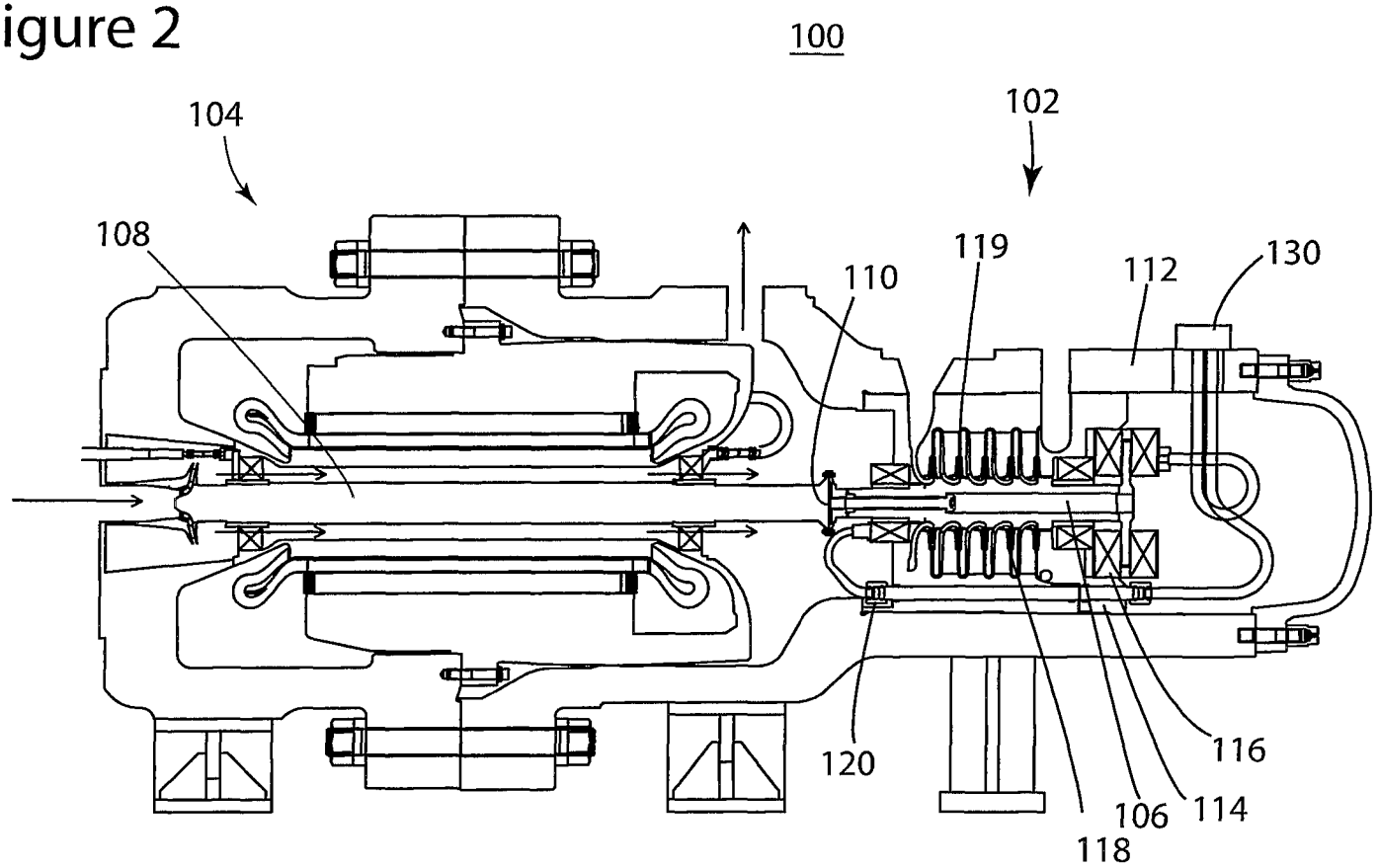
FIG. 2 is a schematic diagram of a turbomachine having a conduit according to an exemplary embodiment.

According to an exemplary embodiment illustrated in FIG. 2, a turbomachine 100 includes a compressor 102 and an electrical motor 104. As noted above, this is an illustrative example and the electrical motor may be substituted by a gas turbine, expander, etc. A compressor shaft 106 of the compressor 102 is connected to a motor shaft 108 of the electrical motor 104 directly with a joint or via a coupling 110. In one application, the coupling 110 may be a Hirth coupling.

The turbomachine 100 has an external casing 112 that is configured to receive a compressor cartridge 114 that practically includes all the components of the compressor 102. In other words, the cartridge 114 is configured to include the compressor shaft 106, magnetic bearings 116 that support the compressor shaft 106, impellers 118 connected to the compressor shaft 106, the statoric diaphragms 119 and other components of the compressor. The cartridge 114 is also configured to slide out of the external casing 112 with all the components of the compressor. In one application, there are wheels embedded either into the external casing 112 or into the cartridge 114 for allowing the cartridge 114 to slide in and out of the external casing 112. Because the coupling 110 is a Hirth coupling or a similar coupling, there is no need that a hatch is provided in the external casing for allowing a person to enter the turbomachine to disconnect the compressor shaft from the motor shaft. This feature advantageously reduces a length of the overall casing and the rotors.

The only connection that is left to be disconnected when removing the cartridge 114 is the electrical connection of the magnetic bearings. However, due to the novel features to be discussed next, this connection is not provided between the compressor and the motor, inside the external casing, as is the case for the traditional devices. As shown in FIG. 2, the magnetic bearing 116 on the left is electrically connected to a connector 120 and then to an external connector 130 while the magnetic bearing 116 on the right is directly connected to the external connector 130.

Figure 3:
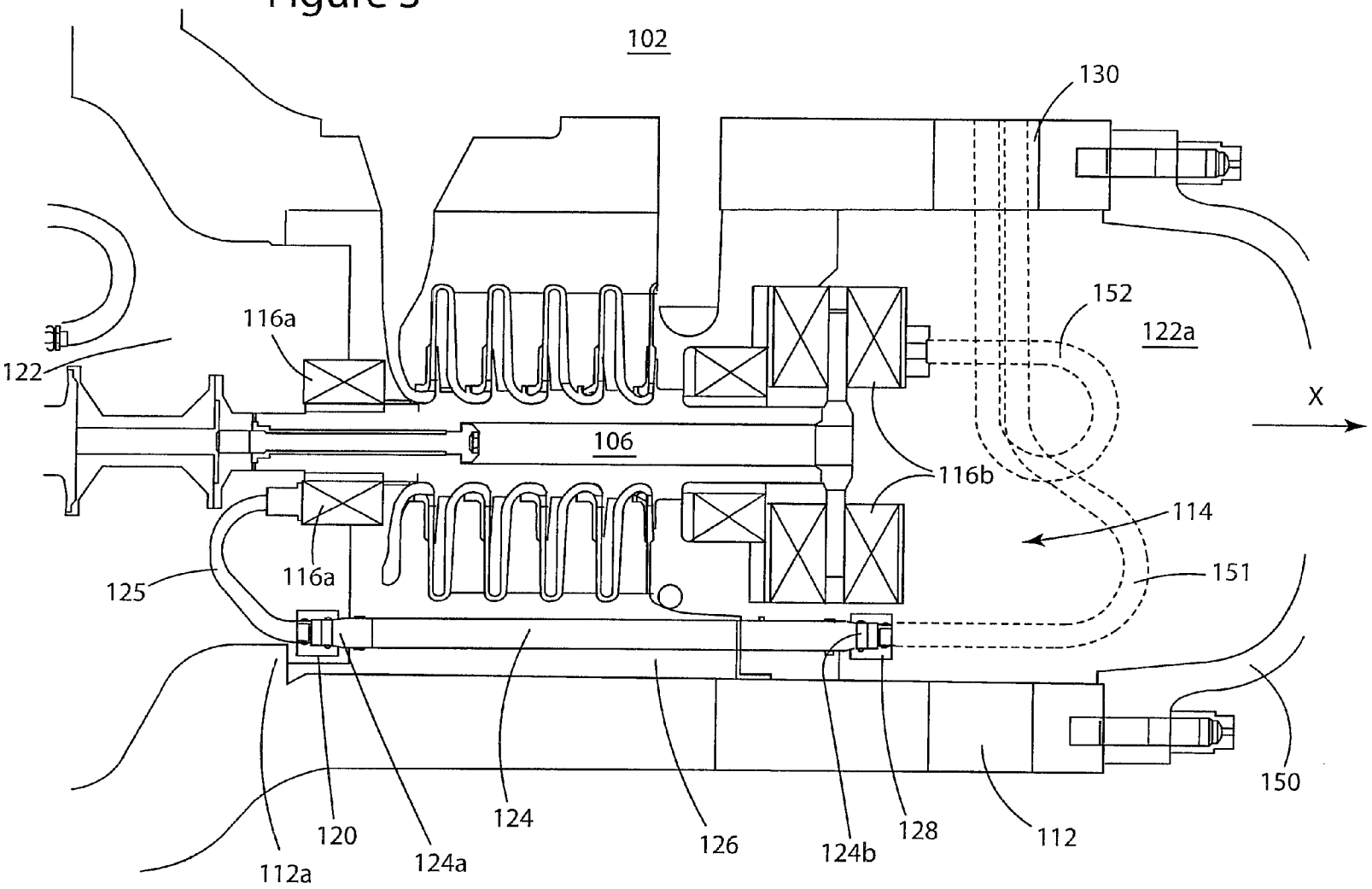
FIG. 3 is a schematic diagram of a compressor having a conduit entering through a statoric part according to an exemplary embodiment.

In an exemplary embodiment shown in FIG. 3, the cartridge 114 is shown inside the external casing 112. A shoulder 112*a* of the external casing 112 is configured to stop the advancement of the cartridge 114 along a direction opposite to axis X. A cover 150 is shown in FIG. 3 closing the external casing 112 and fixing in place the cartridge 114. It is noted that during assembly or disassembly, the cover 150 is easily removable and access inside the external casing 112 is provided. However, no access is provided at region 122 next to the compressor. This region is where the compressor connects to the electrical motor. For simplicity, the electrical motor is not shown in FIG. 3.

The left magnetic bearing is referenced in the following with 116*a* and the right magnetic bearing is referenced with 116*b*. It is noted that in this embodiment, the magnetic bearing 116*a* is connected to an electrical cable 125 that enters the connector 120. Connector 120 screws or attaches by other similar secure means to a first end 124*a* of a conduit 124. Conduit 124 may be a pipe made of a metal, steel or other material that is configured to withstand pressures existing in the compressors. For example, the conduit 124 may be made of a material that is configured to withstand the unfavorable conditions associated with various chemicals that are processed by the compressor.

Figure 4:
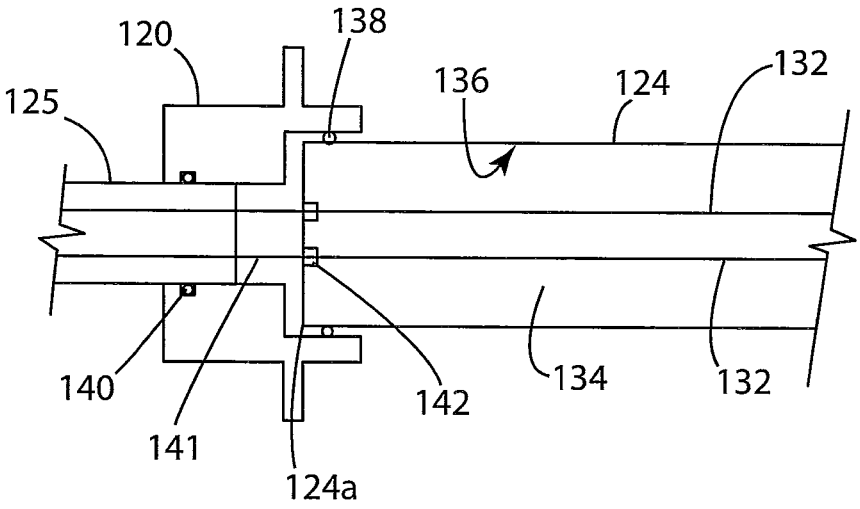
FIG. 4 is a schematic diagram of a conduit to be used in a compressor according to an exemplary embodiment.

The conduit 124 is configured to extend along a statoric part 126 of the compressor. In one application, the first end 124*a* of the conduit exits the statoric part 126. The same is true for the second end 124*b*. The first and second ends 124*a* and 124*b* are configured to receive corresponding connectors 120 and 128. The conduit 124 has a hole inside and this hole is configured to receive electrical cables 132 as shown in FIG. 4, FIG. 4 shows only two cables 132 but the number of cables depends on the application and the type of magnetic bearings. Cables 132 are fixed inside the conduit 124 and extend from the first end 124*a* to the second end 124*b*. Resin, glass or other electrically inert material 134 may be used inside the conduit 124 to fill the gaps between the cables 132 and the wall 136 of the conduit 124.

Figure 5:
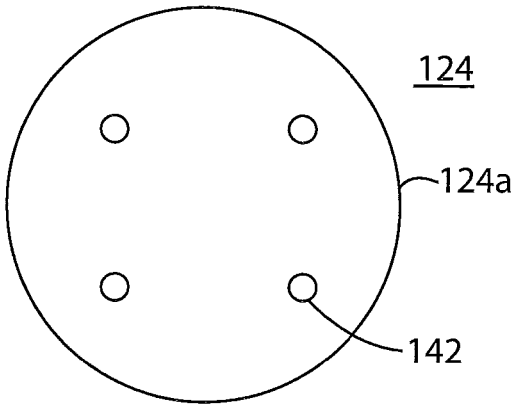
FIG. 5 is a schematic diagram of an end of a conduit to be used in a compressor according to an exemplary embodiment.

The connector 120, as shown in FIG. 4, may include seals 138, 140 for preventing a leaked media from region 122 of the compressor to travel inside the conduit well 136 to region 122*a* of the compressor. The regions 122 and 122*a* may have a large pressure difference and thus, there is a potential for leaked media to travel along the conduit 124, either inside or outside the conduit 124. Further seals 140 may be provided between the connector 120 and cable 125 and similar for connection 128. The connector 120 may have pins 141 that electrically connect to receptacles 142 that are provided at the ends of the conduit 124. Receptacles 142 are in electrically connected with the cables 132. The connector 120 may screw to the first end 124*a* of the conduit 124 or may be attached by other secure means as known in the art, i.e., by welding or gluing or others. An example of the first end 124*a* of the conduit 124 and its receptacles 142 are shown in FIG. 5. In another application, the conduit 124 may have the pins 141 and the connector 120 may have the receptacles 142. The same structure may be used for connector 128. The number and the shape of the seals 138 and 140 may vary according to specific needs. It is also noted that this exact structure of the conduit 124 and its attachments may be used for the magnetic bearings of the motor 104 shown in FIG. 2 as will be discussed later.

Returning to FIG. 3, it is noted that a hole is formed in the statoric part 126 to accommodate the conduit 124. After passing the statoric part 126, a cable 151 connects via the connector 128 to the electrical cables 132 of the conduit 124. This electrical cable 151 connects to the external connector 130 and then to an outside power source for providing the necessary electrical power to the magnetic bearings. Magnetic bearing 116*b* is directly (i.e., not via conduit 124) connected to the external connector 130 by corresponding cables 152.

Figure 6:
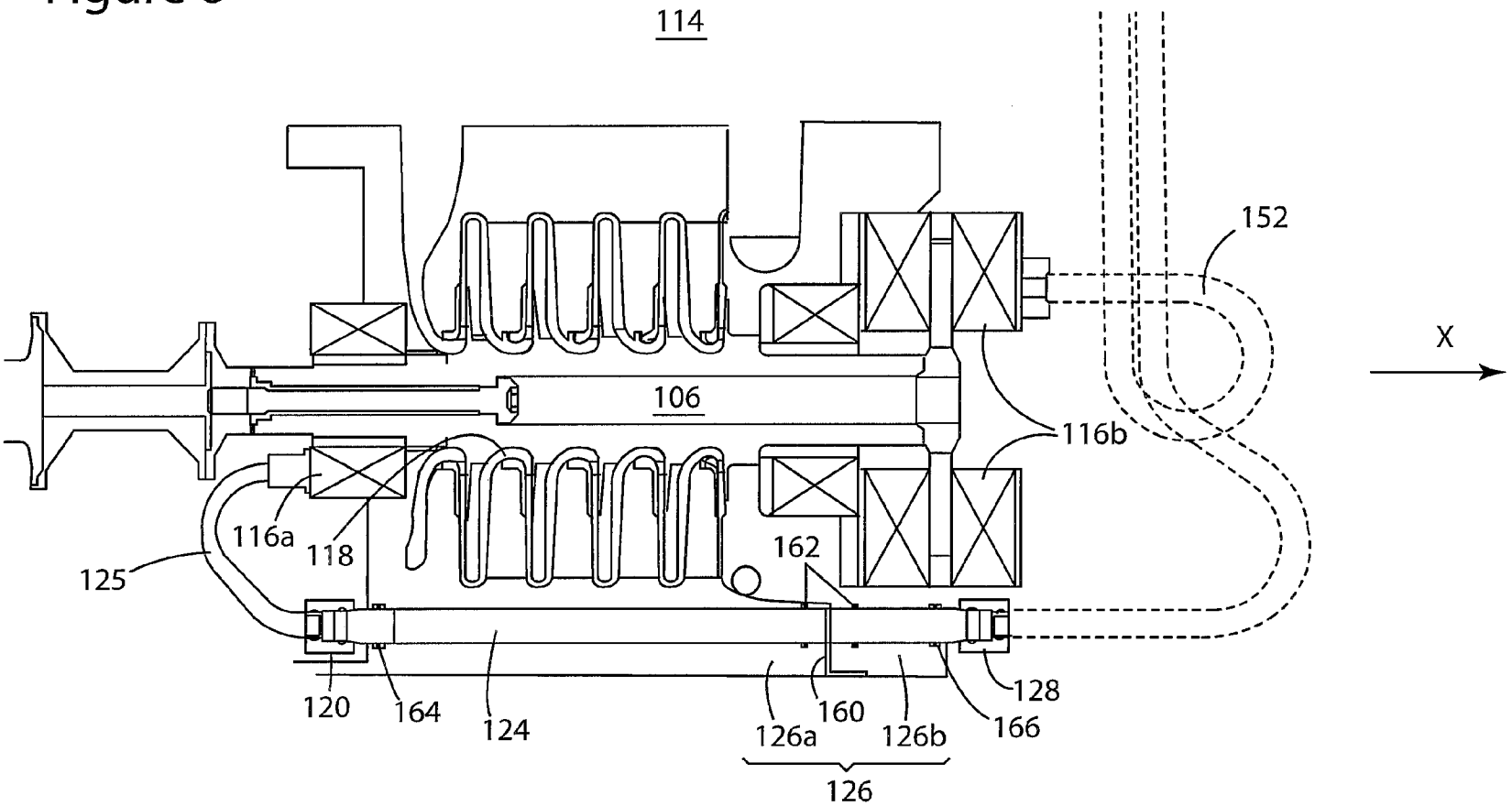
FIG. 6 is a schematic diagram of a cartridge of a compressor having a conduit according to an exemplary embodiment.

FIG. 6 shows the cartridge 114 of the compressor 102 taken out of the external casing 112. It is noted here that the statoric part 126 is split in two portions, 126*a* and 126*b*. The reason for this split is to insert a gap 160 between the two parts so that when a temperature of the compressor increases, the statoric part 126*a* and/or 126*b* is capable of expanding along the X direction. For preventing a leaked media from the compressor to enter the gap 160 and propagate along the conduit 124, seals 162 (e.g., o-rings) are placed around the conduit 124 before and after the gap 160 as shown in FIG. 6. Additional seals 164 and 166 may be placed along the conduit 124, close to the first and second ends 124*a* and 124*b* for preventing a leak to propagate along the conduit 124.

Conduit 124 may be welded or screwed to the statoric part 126 for fixing the conduit 124 to the compressor. Conduit 124 may extend along a direction substantially parallel to the compressor shaft 106. In one application, the conduit 124 extends through an entire region of the statoric part that corresponds to impellers of the compressor. In other words, projections on the axis X of the first end 124*a*, the impellers 118, and the second end 124*b* of the conduit lie in this order.

Figure 7:
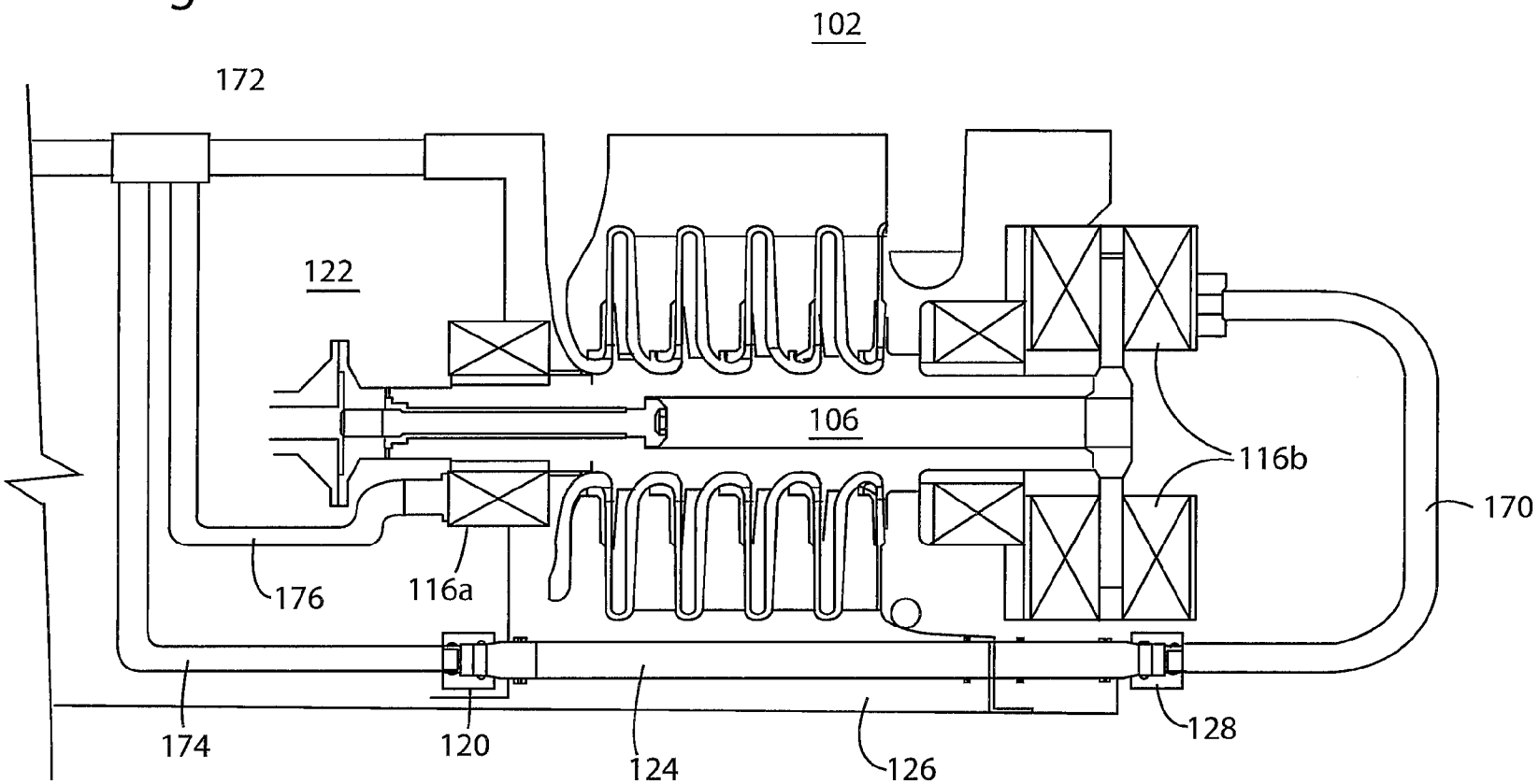
FIG. 7 is a schematic diagram of a cartridge of a compressor having a conduit according to another exemplary embodiment.

In another exemplary embodiment illustrated in FIG. 7, the magnetic bearing 116*b* is connected via a cable 170 to the connector 128 such that electrical power is provided to the magnetic bearing 116*b* from an external connector 172 via cable 174, connector 120, conduit 124, connector 128 and cable 170. The magnetic bearing 116*a* is connected to the external connector 172 via a cable 176. The external connector 172 is placed in this exemplary embodiment between the compressor 102 and the electrical motor 104 (not shown in FIG. 7). However, no external hatch is necessary to be provided in region 122 if the external connector 172 is attached to the cartridge 114. While the above exemplary embodiments have been discussed with regard to magnetic bearings, the novel features of these embodiments may also be applied to other electrical systems provided inside the compressor, e.g., a sensor.

Figure 8A:
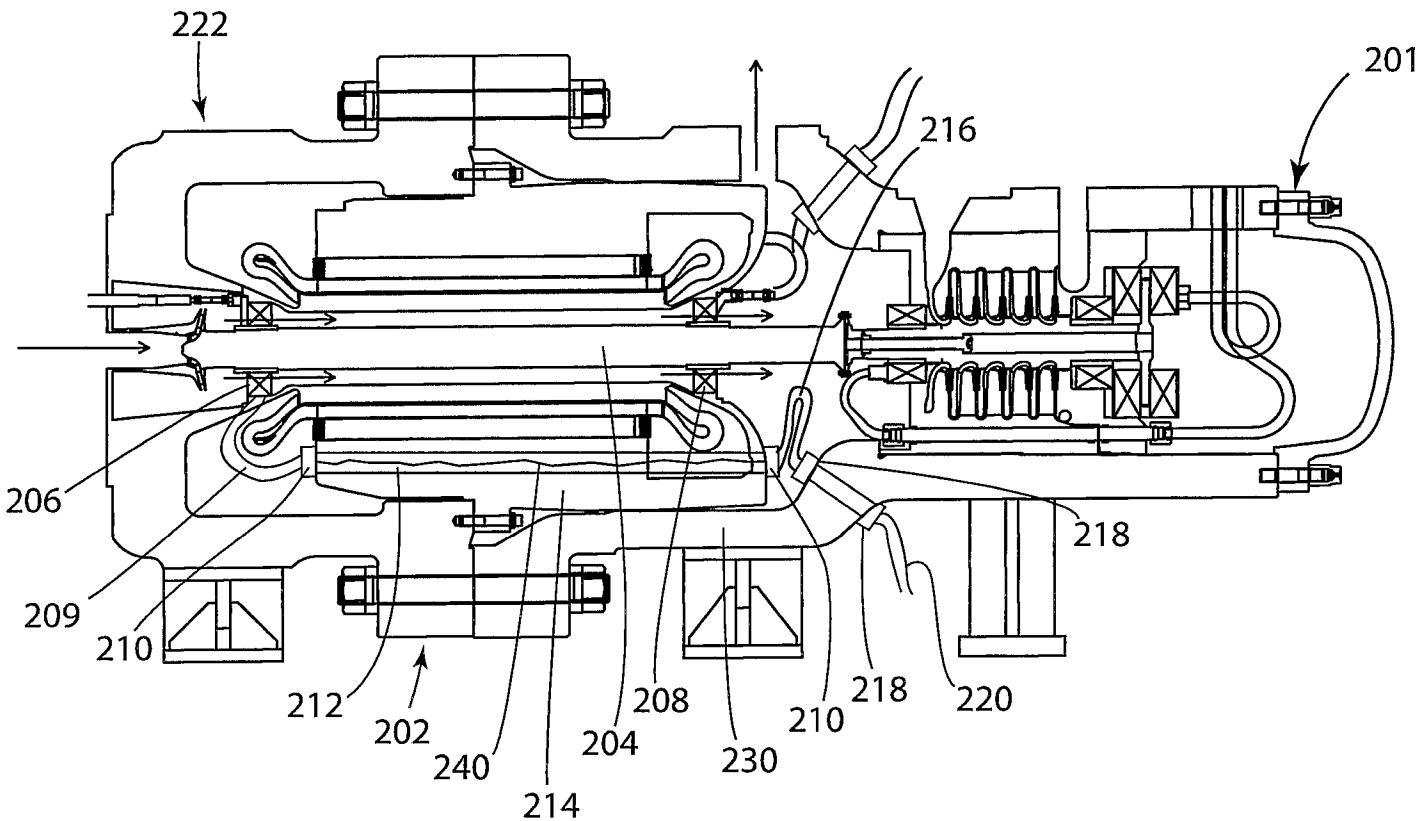
FIG. 8*a* is a schematic diagram of a turbomachine having a conduit inside the motor according to an exemplary embodiment.
Figure 8B:
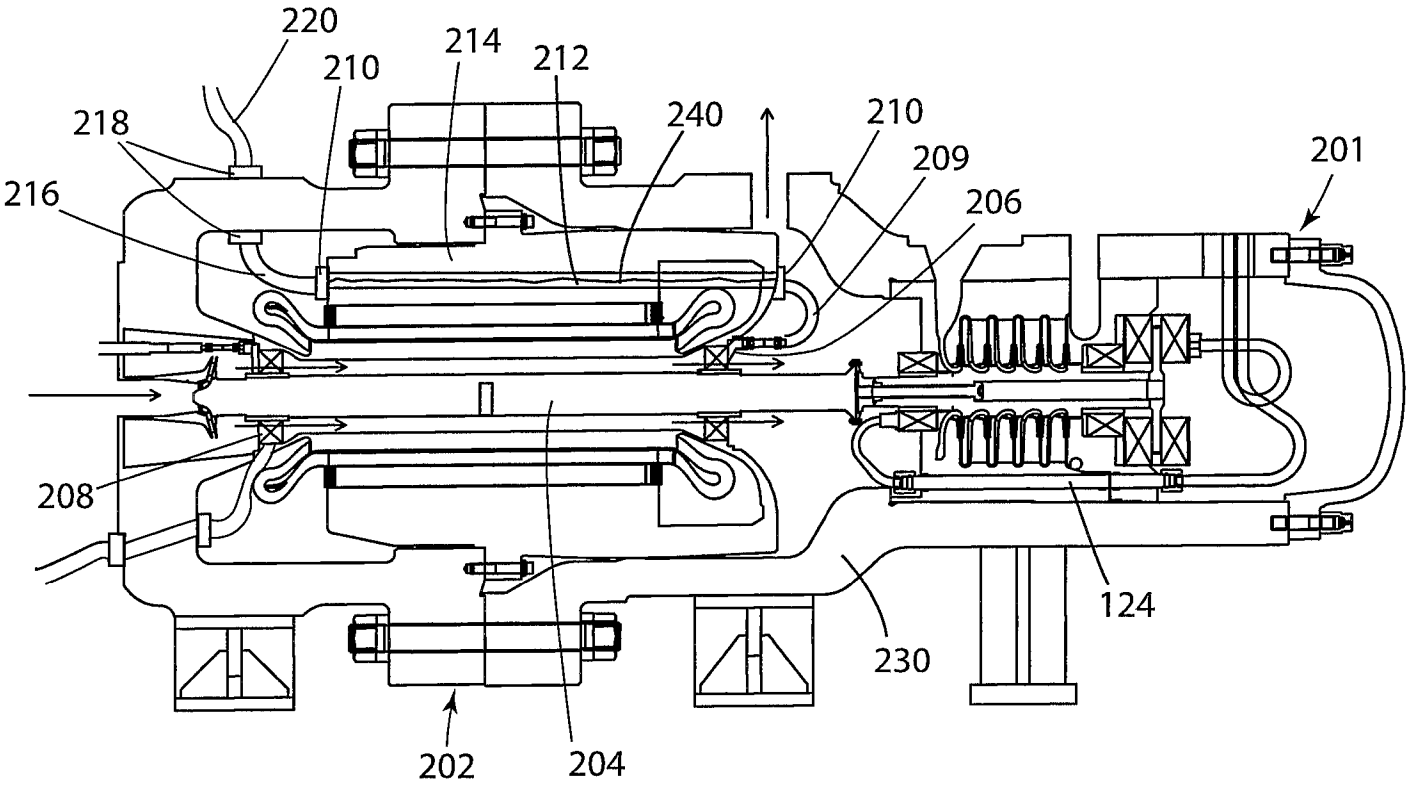
FIG. 8*b* is a schematic diagram of a turbomachine having a conduit inside the motor cartridge according to another exemplary embodiment.

The above embodiments may be applied to the motor. For example, as shown in FIG. 8*a*, the turbomachine 200 includes a compressor 201 and a motor 202. The motor 202 has a shaft 204 supported at both ends by magnetic bearings 206 and 208. The magnetic bearing 206 is connected to a cable 209 that has a connector 210. A conduit 212 is formed through the statoric part 214 of the motor. The conduit 212 may be identical to the conduit 124 discussed above with regard to the compressor. The connector 210 is configured to connect to one end of the conduit 212 and then to another cable 216. Cable 216 connects then to a connector 218 that is connected to an external cable 220. Magnetic bearing 208 is also connected to a connector similar to 218 and to an external cable similar to 220. Similar to conduit 124, the present conduit includes conduit electrical cables 240 that extend from a first end of the conduit 212 to the other end. In another application, the connector 218 may be placed in region 222 of the casing and all the electrical cables connecting the magnetic bearings in the motor may be taken out of the casing at region 222. In another application, as shown in FIG. 8*b*, the motor compressor system 200 has a common casing 230 and the conduit 124 and/or 212 are formed in internal casings of the motor cartridge and the compressor cartridge.

Some advantages of one or more of the exemplary embodiments discussed above are as follows. The magnetic bearings inside the machine may be easily connected or disconnected without the need to enter inside the common casing of the machine. In case of failure, the replacement of the various parts is simplified and there is no need for a skilled person to handle the assembly or disassembly of the machine but only a traditional technician.

Figure 9:
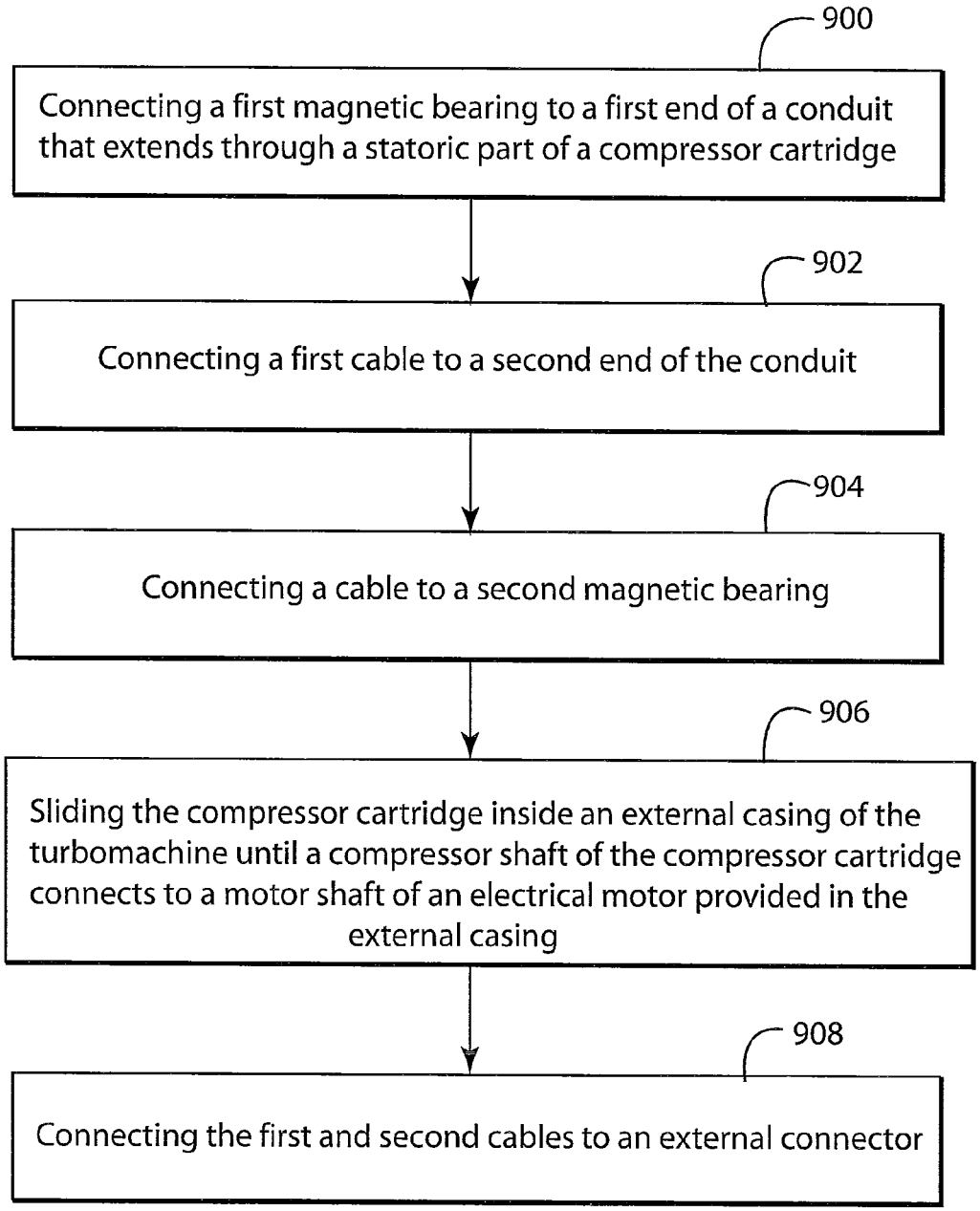
FIG. 9 is a flowchart of a method for connecting magnetic bearings in a compressor according to an exemplary embodiment.

According to an exemplary embodiment illustrated in FIG. 9, there is a method for electrically connecting magnet bearings in a turbomachine. The method includes a step 900 of connecting a first magnetic bearing to a first end of a conduit that extends through a statoric part of a compressor cartridge, a step 902 of connecting a first cable to a second end of the conduit, a step 904 of connecting a cable to a second magnetic bearing, a step 906 of sliding the compressor cartridge inside an external casing of the turbomachine until a compressor shaft of the compressor cartridge connects to a motor shaft of an electrical motor provided in the external casing, and a step 908 of connecting the first and second cables to an external connector. It is noted that the reverse steps may be performed for disassembling the compressor. It is also possible to provide a bleeding conduit from a compressor stage, if required by the application, having an improved seal effect due to the novel features discussed above.

The disclosed exemplary embodiments provide a system and a method for connecting magnetic bearings or other electrical devices inside a compressor and/or a motor to an external plug via a conduit formed inside a statoric part of the compressor and/or the motor. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A turbomachine comprising:

a compressor having a cartridge that is configured to slide in and out of an external casing, wherein the cartridge has a statoric part and a compressor shaft, the compressor shaft being configured to rotate relative to the statoric part;

first and second magnetic bearings provided at opposite ends of the compressor shaft and configured to support the compressor shaft;

a motor having a motor shaft configured to be connected to the compressor shaft;

a conduit configured to extend through the statoric part, from the first magnetic bearings to the second magnetic bearings, the conduit being configured to seal a first pressure region of the compressor from a second pressure region of the compressor;

conduit electrical cables provided inside the conduit and extending from a first end of the conduit to a second end of the conduit; and electrical cables connecting one of the first and second magnetic bearings to an external connector via the conduit electrical cables of the conduit.

2. The turbomachine of claim 1, wherein the electrical cables further comprise:

a first cable configured to electrically connect the first magnetic bearing to the first end of the conduit;

a second cable configured to connect the second end of the conduit to the external connector; and a third cable configured to connect the second magnetic bearing to the external connector.

3. The turbomachine of claim 2, further comprising:

a first connector between the first cable and the conduit electrical cables; and a second connector between the second cable and the conduit electrical cables.

4. The turbomachine of claim 1, further comprising:

another conduit configured to extend through a statoric part of the motor, from a first magnetic bearings to a second magnetic bearings, the conduit being configured to seal a first pressure region of the motor from a second pressure region of the motor.

5. The turbomachine of claim 1, further comprising:

seals between the conduit and the statoric part to prevent a media from the compressor leaking along the conduit.

6. The turbomachine of claim 1, wherein the external casing has no hatch between the compressor and the electrical motor.

7. The turbomachine of claim 1, wherein the conduit extends along a line that is substantially parallel to the compressor shaft.

8. The turbomachine of claim 1, wherein the conduit extends an entire region of the statoric part that corresponds to impellers of the compressor.

9. The turbomachine of claim 1, wherein the statoric part has two statoric components or diaphragms that have at least one gap between them, the conduit extends through both statoric parts and the at least one gap and seals are provided between the conduit and the statoric parts on both sides of the gap to prevent a leakage from the compressor along the conduit.

10. A compressor cartridge comprising:

a compressor connected to a driver machine;

a compressor shaft configured to rotate relative to a statoric part of the compressor;

first and second magnetic bearings provided at opposite ends of the compressor shaft;

a conduit configured to extend through the statoric part such that projections on the compressor shaft of a first end of the conduit, impellers of the compressor and a second end of the conduit lie in this order, the conduit being configured to seal a first pressure region of the compressor from a second pressure region of the compressor; and the conduit includes conduit electrical cables configured to electrically connect the first magnetic bearing and an external connection and the second magnetic bearing is electrically connected to the external connection.

11. The compressor cartridge of claim 10, further comprising:

another conduit configured to extend through a statoric part of the motor, from a first magnetic bearings to a second magnetic bearings, the conduit being configured to seal a first pressure region of the motor from a second pressure region of the motor.

12. The compressor cartridge of claim 10, further comprising:

a first cable configured to electrically connect the first magnetic bearing to the first end of the conduit;

a second cable configured to connect the second end of the conduit to the external connector; and a third cable configured to connect the second magnetic bearing to the external connector.

13. The compressor cartridge of claim 12, further comprising:

a first connector between the first cable and the conduit electrical cables; and a second connector between the second cable and the conduit electrical cables.

14. The compressor cartridge of claim 10, further comprising:

a Hirsch connection between the compressor shaft and the motor shaft.

15. The compressor cartridge of claim 10, further comprising:

seals between the conduit and the statoric part to prevent a media from the compressor leaking along the conduit.

16. The compressor cartridge of claim 10, wherein the external casing has no hatch between the compressor and the electrical motor.

17. The compressor cartridge of claim 10, wherein the conduit extends along a line that is substantially parallel to the compressor shaft.

18. A method for electrically connecting magnet bearings in a turbomachine to an external connector, the method comprising:

connecting a first magnetic bearing to a first end of a conduit that extends through a statoric part of a compressor cartridge;

connecting a first cable to a second end of the conduit;

connecting a cable to a second magnetic bearing;

sliding the compressor cartridge inside an external casing of the turbomachine until a compressor shaft of the compressor cartridge connects to a motor shaft of an electrical motor provided in the external casing; and connecting the first and second cables to an external connector.

19. The method of claim 18, wherein the conduit is configured to extend through the statoric part, from the first magnetic bearings to the second magnetic bearings to seal a first pressure region of the compressor from a second pressure region of the compressor.

20. A turbomachine comprising:

a compressor having a cartridge that is configured to slide in and out of an external casing, wherein the cartridge has a statoric part and a compressor shaft, the compressor shaft being configured to rotate relative to the statoric part;

first and second magnetic bearings provided at opposite ends of the compressor shaft and configured to support the compressor shaft;

a motor having a motor shaft configured to be connected to the compressor shaft;

third and fourth magnetic bearings provided at opposite ends of the motor shaft;

a first conduit configured to extend through the statoric part of the compressor, from the first magnetic bearings to the second magnetic bearings, the conduit being configured to seal a first pressure region of the compressor from a second pressure region of the compressor;

a second conduit configured to extend through a statoric part of the motor, from a first magnetic bearings to a second magnetic bearings, the conduit being configured to seal a first pressure region of the motor from a second pressure region of the motor; and electrical cables connecting the magnetic bearings of the compressor and the motor to external connectors via conduit electrical cables of the first conduit and the second conduit.

* * * * *